US009663882B2

(12) United States Patent
Haskett et al.

(10) Patent No.: US 9,663,882 B2
(45) Date of Patent: May 30, 2017

(54) NATURAL FIBER NONWOVEN SCOURING MATERIAL AND METHODS OF MAKING

(76) Inventors: Thomas E. Haskett, Oakdale, MN (US); Shridhar B. Shinde, Maharashtra (IN); Abhijeet A. Saungikar, Bangalore (IN)

( * ) Notice: Subject to any disclaimer, the term of this patent is extended or adjusted under 35 U.S.C. 154(b) by 1615 days.

(21) Appl. No.: 13/129,002

(22) PCT Filed: Nov. 12, 2009

(86) PCT No.: PCT/US2009/064173

§ 371 (c)(1),
(2), (4) Date: Aug. 1, 2011

(87) PCT Pub. No.: WO2010/056835

PCT Pub. Date: May 20, 2010

(65) Prior Publication Data

US 2011/0277261 A1 Nov. 17, 2011

Related U.S. Application Data

(60) Provisional application No. 61/113,741, filed on Nov. 12, 2008.

(51) Int. Cl.
*A47L 17/08* (2006.01)
*D04H 1/60* (2006.01)
(Continued)

(52) U.S. Cl.
CPC ..... *D04H 1/60* (2013.01); *A47L 13/16* (2013.01); *B24D 13/12* (2013.01); *D04H 1/413* (2013.01); *D04H 1/425* (2013.01); *D04H 1/54* (2013.01)

(58) Field of Classification Search
CPC ..... D04H 1/60; D04H 1/413; D04H 1/425; D04H 1/54; A47L 13/16; B24D 13/12
(Continued)

(56) References Cited

U.S. PATENT DOCUMENTS 2,327,199 A 8/1943 Loeffler
2,375,585 A 5/1945 Rimer
(Continued)

FOREIGN PATENT DOCUMENTS

CA 2271457 11/1999
EP 1618239 8/2007
(Continued)

OTHER PUBLICATIONS

International Search Report, PCT/US2009/064173, 3 pages.

*Primary Examiner* — Shay Karls
(74) *Attorney, Agent, or Firm* — Ann K. Gallagher

(57) ABSTRACT

An open, lofty nonwoven scouring material comprising natural fibers and a method of making the scouring material is disclosed. The scouring material comprises a three dimensional nonwoven web of entangled fibers comprising natural vegetable fibers and synthetic fibers. Natural vegetable fibers comprise 20 to 80% wt. of the fibers of the web. The synthetic fibers comprise at least first synthetic fibers having a first melting point and second synthetic fibers having a second melting point that is higher than the first melting point. The first synthetic fibers entirely melt and coalesce at mutual contact point of the natural fibers and second synthetic fibers to bond the fibers together and to create voids. The bonded web has a maximum density of 60 kg/m$^3$.

12 Claims, 2 Drawing Sheets

(51) Int. Cl.

| | |
|---|---|
| ***A47L 13/16*** | (2006.01) |
| ***B24D 13/12*** | (2006.01) |
| ***D04H 1/54*** | (2012.01) |
| ***D04H 1/413*** | (2012.01) |
| ***D04H 1/425*** | (2012.01) |

(58) Field of Classification Search
USPC ..... 15/229.12, 209.1
See application file for complete search history.

(56) References Cited

U.S. PATENT DOCUMENTS

| | | | | |
|---|---|---|---|---|
| 2,958,593 | A | 11/1960 | Hoover | |
| 3,175,331 | A | 3/1965 | Klein | |
| 3,516,941 | A | 6/1970 | Matson | |
| 5,134,746 | A | 8/1992 | William | |
| 5,458,962 | A * | 10/1995 | Birch | 442/104 |
| 5,685,935 | A | 11/1997 | Heyer | |
| 5,712,210 | A | 1/1998 | Windisch | |
| 6,360,478 | B1 * | 3/2002 | Spittle | 47/9 |
| 7,585,390 | B2 * | 9/2009 | Nunn et al. | 162/147 |
| 2003/0200991 | A1 | 10/2003 | Keck | |
| 2005/0098910 | A1 | 5/2005 | Andersen | |
| 2007/0026754 | A1 * | 2/2007 | Rivera et al. | 442/402 |

FOREIGN PATENT DOCUMENTS

| | | |
|---|---|---|
| JP | 11-318791 | 11/1999 |
| WO | WO 00/06341 | 2/2000 |
| WO | WO 2004/097095 | 11/2004 |

* cited by examiner

NATURAL FIBER NONWOVEN SCOURING MATERIAL AND METHODS OF MAKING

CROSS REFERENCE TO RELATED APPLICATIONS

This application is a national stage filing under 35 U.S.C. 371 of PCT/US2009/064173, filed Nov. 12, 2009, which claims priority to U.S. Provisional Application No. 61/113,741, filed Nov. 12, 2008, the disclosures of which are incorporated by reference in their entirety herein.

BACKGROUND

The present disclosure relates to a nonwoven cleaning article and methods of making. In particular, the present disclosure relates to an open and lofty nonwoven cleaning article that comprises natural fibers.

Nonwoven articles are used extensively in cleaning, abrading, finishing and polishing applications on a variety of surfaces. An example of an open, lofty, three dimensional nonwoven is described in U.S. Pat. No. 2,958,593 to Hoover et al. Such nonwoven webs comprise a plurality of synthetic fibers randomly arranged and secured together by an adhesive binder. Examples of scouring pads comprising nonwoven fibrous materials are described in U.S. Pat. No. 2,327,199 (Loeffler), U.S. Pat. No. 2,375,585 (Rimer), and U.S. Pat. No. 3,175,331 (Klein). Nonwoven fibrous hand pads for domestic use and for more general abrasive applications are available, under the trademark "Scotch-Brite," from 3M Company of St. Paul, Minn., USA, and nonwoven fibrous hand pads that provide mild scouring for skin cleansing are available, under the trademark "Buf-Puf," also from 3M Company. Nonwoven fibrous scouring materials are also used outside the domestic environment, for example in floor pads such as those available, also under the trademark "Scotch-Brite", from 3M Company.

A nonwoven fibrous scouring material is preferably a relatively open material (i.e. it has a comparatively high void volume, typically of at least 50%) so that it can retain debris removed from the surface that is being cleaned. Such a material can also be cleaned very easily by rinsing in water or another suitable liquid, so that it can be re-used.

Known processes for manufacturing nonwoven fibrous materials having a comparatively high void volume involve forming an open, three-dimensional nonwoven web of synthetic fibers, applying a liquid binder resin to the web, and then curing the binder resin to bond the fibers together. A preferred method of applying the binder resin is roll coating, which coats the fibers with the resin substantially continuously throughout the web. Abrasive particles can be adhered to the bonded web to enhance the abrasive characteristics of the web.

The use of a substantial amount of natural vegetable fibers in place of synthetic fibers in a conventional manufacturing process of the type described above has not been seen as an option for mass-producing nonwoven fibrous scouring materials having a comparatively high void volume because of the risk that the vegetable fibers will be crushed during the web forming process, when the liquid binder resin is applied, or both. A crushed web with a void volume of substantially less that 50% is too compact to function effectively as a scouring material. The risk of the fibers being crushed is considered to be particularly high if the binder resin is applied by roll coating. With that mind, EP-A-1 618 239 (3M Innovative Properties (Company) describes a method of making a scouring material comprising the steps of: forming a three-dimensional nonwoven web of natural fibers contacted with dry particulate material that includes fusible binder particles; exposing the web to conditions that cause the binder particles to form a flowable liquid binder; and then solidifying the liquid binder to form bonds between the fibers of the web and thereby provide a bonded web. Abrasive particles are then adhered to the pre-bonded web by at least a make-coat resin.

Although the method described in EP-A-1 618 239 is effective, it requires the use of an apparatus that is less widely available than that used to carry out the conventional type of manufacturing process referred to above. It would be advantageous to be able to continue to use the conventional type of process to produce nonwoven fibrous scouring materials comprising of natural vegetable fibers, and the present invention is based on the surprising discovery that this can be achieved through an appropriate selection of the fibers employed.

SUMMARY

Disclosed is a scouring material that comprises an open, lofty, three-dimensional nonwoven web of fibers, including natural fibers, and methods of making. The terms "open" and "lofty" indicate that the bonded web is of comparatively low density, having a network of many, relatively large, intercommunicated voids. These terms indicate that the bonded web has a density no greater than 60 kg/m$^3$.

It has been found that an open and lofty scouring material can be made that is capable of providing an effective scouring action despite the fact that natural fibers from which it is composes are traditionally associated with nonwoven materials having a low void-volume and/or a low abrasive action.

In one embodiment, the scouring material comprises a three dimensional nonwoven web of entangled fibers comprising natural fibers and synthetic fibers. Natural vegetable fibers comprise 20 to 80% wt. of the fibers of the web. The synthetic fibers comprise at least first synthetic fibers having a first melting point and second synthetic fibers having a second melting point that is higher than the first melting point. The first synthetic fibers entirely melt and coalesce at mutual contact point of the natural fibers and second synthetic fibers to bond the fibers together and to create voids. The bonded web has a maximum density of 60 kg/m$^3$.

In one embodiment, a method of making the scouring material comprises providing a plurality of fibers comprising natural fibers and synthetic fibers, wherein 20 to 80% wt. of the fibers are natural vegetable fibers, and wherein the synthetic fibers comprise at least first synthetic fibers having a first melting point and second synthetic fibers having a second melting point that is higher than the first melting point, mixing the fibers to form a mat, melting the entire first synthetic fibers to create voids in the mat, coalescing the melted first synthetic fibers to bond the natural fibers and second synthetic fibers together, wherein the bonded web has a maximum density of 60 kg/m$^3$.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
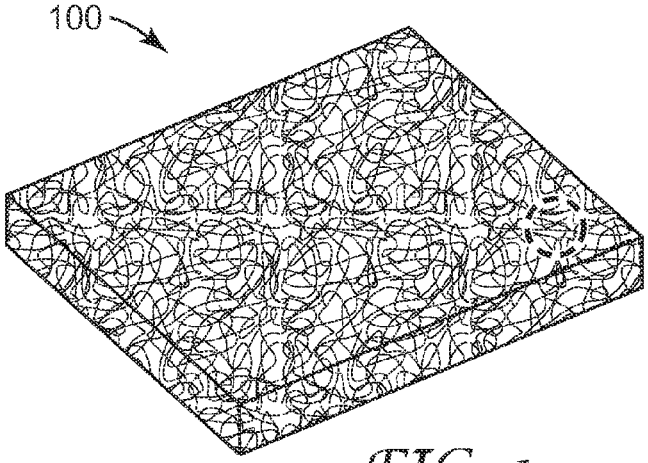
FIG. 1 is a perspective view of one embodiment of a nonwoven article.
Figure 2:
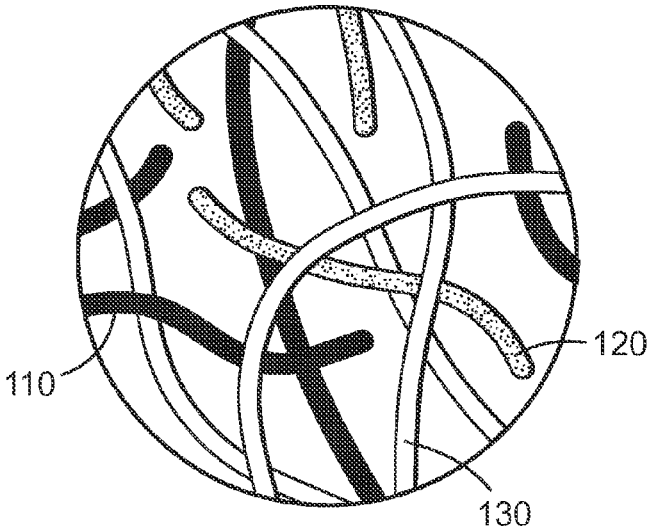
FIG. 2 is an exploded view a nonwoven article of FIG. 1 following formation, but prior to melting of the meltable fiber.

FIG. 1 is a perspective view of one embodiment of a nonwoven article 100. FIG. 2 is an exploded view the nonwoven article 100 of FIG. 1 following formation of the nonwoven article. As shown in FIG. 2, the nonwoven article 100 comprises natural fibers 110 and synthetic fibers, wherein the synthetic fibers comprise at least a first synthetic fiber 120, and a second synthetic fiber 130. During formation, the fibers are all randomly arranged to form a mat of fibers.

The nonwoven article 100 comprises from 20 to 80% wt. natural fibers 110. In one embodiment, the nonwoven article 100 comprises from 40 to 70% wt. natural fibers 110. Therefore, in one embodiment 20 to 80% of the nonwoven article 100 comprises synthetic fibers. In another embodiment, from 30 to 60% wt. of the nonwoven article 100 comprises synthetic fibers. Of the synthetic fibers included in the nonwoven article 100, from 20 to 60% wt. are first synthetic fibers 120 (discussed in more detail below). In another embodiment, 30 to 40% wt. of the synthetic fibers are first synthetic fibers 120.

The first synthetic fiber 120 has a first melting temperature. The second synthetic fiber 130 has a second melting temperature. The second melting temperature is higher that the first melting temperature. During formation of the nonwoven article 100, the fibers are exposed to heat to melt the first synthetic fiber 120 entirely.

During heating, the first synthetic fiber 120 will melt, while the second synthetic fiber 130, having a higher melting point, will at least partially or will completely remain intact. During melting, the first synthetic fiber 120 tends to collect at junction points where fibers contact one another. Then, upon cooling, the material of the first synthetic fiber 120 will coalesce and resolidify at the junction points of the natural fiber 110 and second synthetic fiber 130 to secure the web together.

Figure 3:
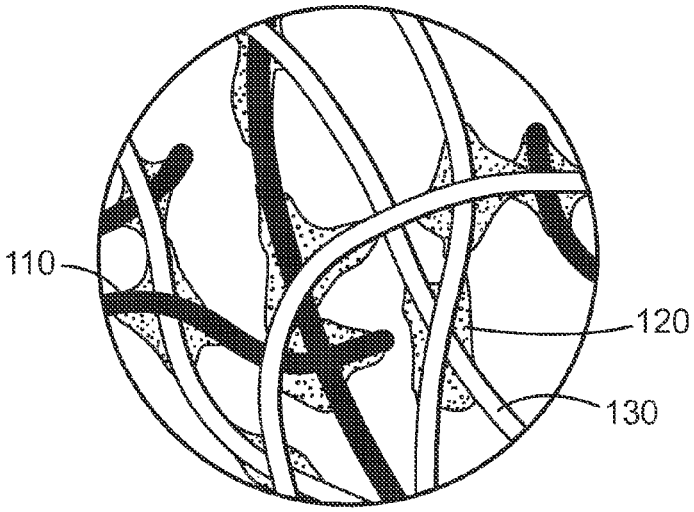
FIG. 3 is an exploded view of the nonwoven article of FIGS. 1 and 2, following melting of the meltable fiber.

FIG. 3 shows the nonwoven article 100 of FIGS. 1 and 2 following melting and resolidifying of the first synthetic fiber 120. Following melting and resolidifying, the space occupied by the first synthetic fiber (see FIG. 2), is now open (see FIG. 3). Therefore, there are now more openings in the nonwoven article 100. A large amount of sizable openings in a nonwoven article make the nonwoven suitable for scouring and cleaning because the dirt and debris scraped away by the fibers then becomes trapped in the openings until the nonwoven article is rinsed.

Natural fibers tend to crush or break under stressed imposed during textile or web formation processing. However, synthetic fibers are much more resilient and tend to have a "memory" such that under the pressures imposed during processing, the synthetic fiber will tend to return to its original shape. This tendency to return to its original shape makes the presence of the second synthetic fiber, that does not entirely melt, useful in retaining a lofty, springy web.

Further, it is believed that the material of the first synthetic fiber that melts and coalesces at junction points of the second synthetic 130 and natural fiber 110, gives strength to the second synthetic 130 and natural fiber 110 and aids in retaining the original lofty shape of the web even under subsequent processing.

The first synthetic fiber 120 and second synthetic fiber 130 may be single component or multicomponent synthetic fibers. The component(s) of the first synthetic fiber 120 must be capable of melting, either partially or entirely, while a portion of the second synthetic fiber 130 remains at least partially intact. In one embodiment, the first synthetic fiber 120 entirely melts, while a portion of the second synthetic fiber 130 remains at least partially intact.

If the first synthetic fiber 120 is a single component fiber, then the melting point of the single component must be lower than the melting point of the highest melting point component of the second synthetic fiber 130. Therefore, the second synthetic fiber 130 may be a multicomponent fiber wherein one portion may or may not melt, but another portion has a melting point higher than the component of the first synthetic fiber such that it remains intact.

If the first synthetic fiber 120 is a multicomponent fiber, then the melting point of each of the components of the first synthetic fiber 120 is lower than the melting point of the highest melting point component of the second synthetic fiber 130. Therefore, the second synthetic fiber 130 may be a multicomponent fiber wherein one portion may or may not melt, but another portion has a melting point higher than each of the components of the first synthetic fiber such that it remains intact.

Examples of materials of the first synthetic fiber and/or synthetic synthetic fiber include polyester and copolyester (e.g., polyethylene terephthalate), nylon (e.g., hexamethylene adipamide, polycaprolactam), polypropylene, acrylic (formed from a polymer of acrylonitrile), cellulose acetate, vinyls such as poly vinyl chloride and vinyl chloride-vinyl acetate polymer, polyvinyl butyral, polyvinylidene chloride-vinyl chloride copolymers, vinyl chloride-acrylonitrile copolymers, acrylics including polyacrylic and acrylic copolymers such as acrylonitrile styrene copolymers and polyamides such as hexamethylene adipamide, polycaprolactum and copolyamides, PLA, and other meltable, natural based polymers. Multicomponent fibers may be bicomponent fibers. One example of a bicomponent fiber is a sheath/core fiber. Other multicomponent polymeric fibers are within the scope of the present inventions. Other multi-component fibers may consist of a layered structure where one layer has a first melting point and another layer has a second melting point lower than the first melting point. In such an arrangement, the layer with the second melting point will melt and resolidify to secure the web together.

The first and/or second synthetic fibers used may be virgin fibers or waste fibers reclaimed from garment cuttings, carpet manufacturing, filter manufacturing, fiber manufacturing, or textile processing, or from post-consumer use. The first and/or second synthetic fibers may be linear or crimped. A crimped fiber may aid in providing more loft to the nonwoven article.

The first and/or second synthetic fibers can be in any number of lengths and sizes. For example, these fibers may range in length from 2 to 250 mm and from 1.5 to 200 denier. They may be linear, crimped, or surface modified that imparts texture. The first and/or second synthetic fibers may be approximately the same length and size or may be different lengths and sizes. However, it is understood that the fibers can be as small as the lowest length of fiber that are capable of being cut.

Suitable natural fibers include vegetable fibers such as banana, flax, cotton, jute, agave, sisal, coconut, soybean, and hemp. For a nonwoven article that will be used for scouring, preferably the natural fiber is stiff and relatively rigid. For example, fibers such as, but not limited to, jute, agave, sisal, coconut and hemp may be preferred natural fibers for making a nonwoven article for scouring. In one example, coconut fibers are particularly suitable as a fiber for making a nonwoven article for scouring. The coconut fibers are stiff and abrasive in part due to it high lignin content. The natural fibers used may be virgin fibers or waste fibers reclaimed from other manufacturing processing or post-consumer use.

The natural fibers may include a surface treatment. Generally, the surface treatment makes the natural fiber softer, more non-linear, and more absorbent. The natural fibers may be treated with surface treatments to aid in adhering the polymer resin of the melted first synthetic fiber 120 or to aid in adhering any subsequent binder coatings (discussed below), because following surface treatment the natural fiber is more absorbent. The surface treatment may include a chemical surface treatment such as exposure to mild acid treatment such as acetic acid, or exposure to basic conditions such as sodium hydroxide. The surface treatment may be application of superheated steam, plasma treatment, e-beam or gamma ray treatment. The natural fibers may be treated with a fire retardant to aid in safe processing or for providing a nonwoven web with fire resistance. The surface treatment may be conducted to the pure natural fibers or following formation of the web the surface of the web may be treated.

Figure 4:
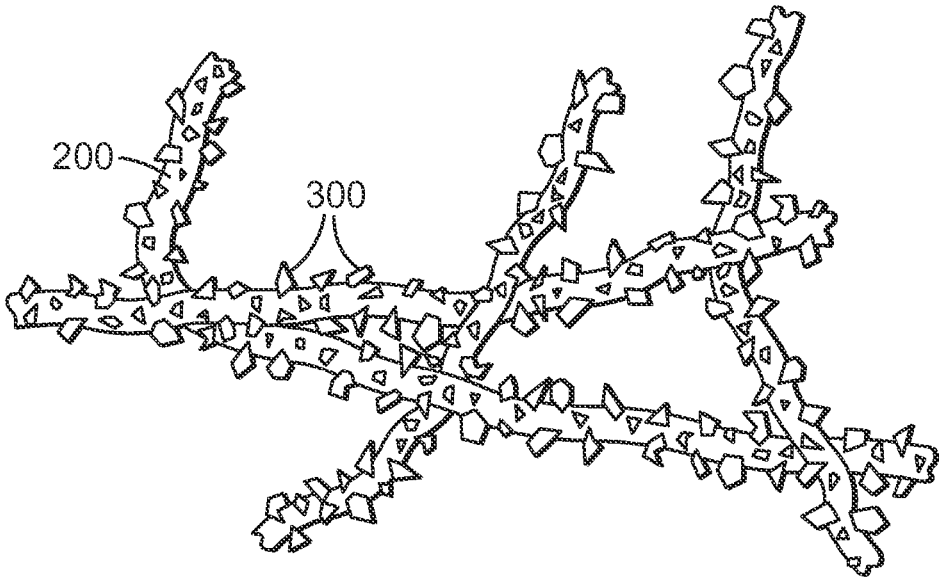
FIG. 4 is an exploded view of a nonwoven article, such as shown in FIG. 1, a binder coating and abrasive particles.

Following formation of a web comprising the natural fibers 110, melted first synthetic fiber 120, and second synthetic fiber 130, the web may be coated with a binder 200. The binder 200 may provide further mechanical strength to the nonwoven article and/or may provide additional stiffness for an abrasive or scouring article. FIG. 4 is an exploded view of a nonwoven article 100, such as shown in FIG. 1, with a binder coating 200 and benefiting particles 300, such as abrasive particles. The benefiting particles 300 may be included with the binder 200 or separately applied following application of the binder 200.

The binder 200 may be applied by known processing means such as roll coating, spray coating, immersion coating, or foam coating. The binder may be a resin. Suitable resins include phenolic resins, polyurethane resins, polyureas, styrene-butadiene rubbers, nitrile rubbers, epoxies, acrylics, and polyisoprene. The binder may be water soluble. Examples of water soluble binders include water-soluble binders include surfactants, polyethylene glycol, polyvinylpyrrolidones, polylactic acid (PLA), polyvinylpyrrolidone/vinyl acetate copolymers, polyvinyl alcohols, carboxymethyl celluloses, hydroxypropyl cellulose starches, polyethylene oxides, polyacrylamides, polyacrylic acids, cellulose ether polymers, polyethyl oxazolines, esters of polyethylene oxide, esters of polyethylene oxide and polypropylene oxide copolymers, urethanes of polyethylene oxide, and urethanes of polyethylene oxide and polypropylene oxide copolymers.

The benefiting particles 300 can be any discrete particle, which is a solid at room temperature, added to the nonwoven article 100 to provide a cleaning, scouring, polishing, wiping, absorbing, adsorbing, or sensory benefit to the nonwoven article. In one embodiment, the benefiting particles 300 have size of less than 1 cm. In other embodiments, the benefiting particles have a size of less than 1 mm.

In one embodiment, the benefiting particles 300 are abrasive particles. Abrasive particles are used to create an abrasive nonwoven article 100 that can scour and abrade difficult to remove material during cleaning. Abrasive particles may be mineral particle, synthetic particles, natural abrasive particles or a combination thereof. Examples of mineral particles include aluminum oxide including ceramic aluminum oxide, heat-treated aluminum oxide and white-fused aluminum oxide; as well as silicon carbide, alumina zirconia, diamond, ceria, cubic boron nitride, garnet, flint, silica, pumice, and calcium carbonate. Synthetic particles include polymeric materials such as polyester, polyvinylchloride, methacrylate, methylmethacrylate, polycarbonate, melamine, and polystyrene. Natural abrasive particles include nutshells such as walnut shell, or fruit seeds such as apricot, peach, and avocado seeds.

Various sizes, hardness, and amounts of abrasive particles may be used to create an abrasive nonwoven article 100 ranging from very strong abrasiveness to very light abrasiveness. In one embodiment, the abrasive particles have a size greater than 1 mm. In another embodiment, the abrasive particles have a size less than 1 cm.

In one embodiment, the benefiting particles 300 are metal. The metal particles may be used to create a polishing nonwoven article 100. The metal particles may be in the form of short sections or may be in the form of grain-like particles. The metal particles can include any type of metal such as but not limited to steel, stainless steel, copper, brass, gold, silver (which has antibacterial/antimicrobial properties), platinum, bronze or blends of one or more of various metals.

In one embodiment, the benefiting particles 300 are solid materials typically found in detergent compositions, such as surfactants and bleaching agents. Examples of solid surfactants include sodium lauryl sulfate and dodecyl benzene sulfonate. Examples of solid bleaching agents include inorganic perhydrate salts such as sodium perborate mono- and tetrahydrates and sodium percarbonate, organic peroxyacids derivatives and calcium hypochlorite.

In one embodiment, the benefiting particles 300 are solid biocides or antimicrobial agents. Examples of solid biocide and antimicrobial agents include halogen containing compounds such as sodium dichloroisocyanurate dihydrate, benzylkoniumchloride, halogenated dialkylhydantoins, and triclosan.

In one embodiment, the benefiting particles 300 are microcapsules. Microcapsules are described in U.S. Pat. No. 3,516,941 to Matson and include examples of the microcapsules that can be used as the benefiting particles 300. The microcapsules may be loaded with solid or liquid fragrance, perfume, oil, surfactant, detergent, biocide, or antimicrobial agents. One of the main qualities of a microcapsule is that by means of mechanical stress the particles can be broken in order to release the material contained within them. Therefore, during use of the nonwoven article 100, the microcapsules will be broken due to the pressure exerted on the nonwoven article 100, which will release the material contained within the microcapsule.

It is understood that any combination of one or more of the above described benefiting particles 300 may be used within the nonwoven article 100.

As discussed, the benefiting particle 300 may be included with the binder 200 and applied to the nonwoven article 100 during application of the binder 200. In such an application, typically a slurry is formed with the binder 200 and benefiting particles 300. In another embodiment, the benefiting particles 300 may be separately sprayed, dropped or otherwise adhered to the already applied binder 200.

Figure 5:
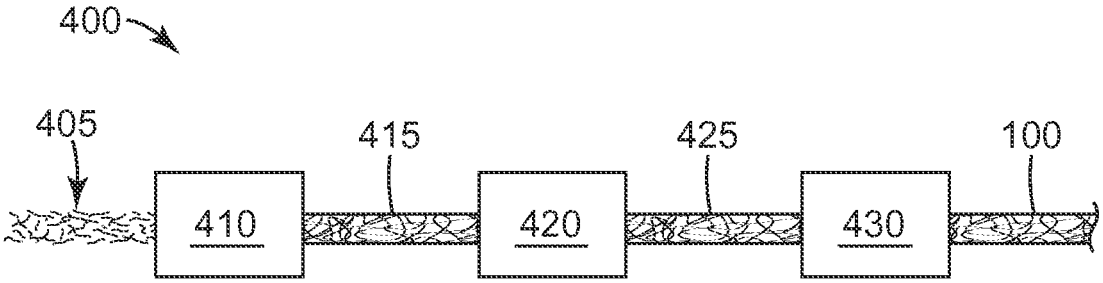
FIG. 5 is a side view of one embodiment of a process of making a nonwoven article.

FIG. 5 is a side view showing one embodiment of the process 400 of making the nonwoven article 100 discussed above. A fiber input stream 405 comprises natural fibers 110, first synthetic fibers 120, and second synthetic fibers 130 that proceed to the web forming apparatus 410. The fiber input stream 405 may be a single input stream comprising all of the input fibers, or a variety of fiber input streams may be included to enter into the web forming apparatus 410. Fibers can be fed unopened, processed, individualized or pre-opended form, fiber lap form, or sliver form.

Prior to entering the web forming apparatus 410, the input fibers may be processed through a shredder to chop fibers or create fibers from recycled material, an opener to open, comb, or blend the fibers, or a surface treatment such as a chemical solution treatment, superheated steam, gamma ray, e-bean treatment.

The web forming apparatus 410 may include any know web forming apparatus. The web forming apparatus 410 randomly mixes the input stream 405 of fibers to form a loose web 415 that exits the web forming apparatus 410. One example of a web forming apparatus is shown and described in US Patent Application Publication 2005/0098910 titled "Fiber distribution device for dry forming a fibrous product and method," the disclosure of which is herein incorporated by reference. This web forming apparatus is a type of air-laying fiber processing equipment. In this type of equipment, within a forming box are spike rollers that blend and mix the fibers while gravity allows the fibers to fall down through an endless belt screen and form the loose web 415 of interengaged fibers.

Another type of air-laid equipment that may be used for form a loose web 415 is described in U.S. Pat. No. 2,958,593. A commercially available web forming apparatus is a "RandoWebber" web forming machine, available from Rando Machine Corporation, Macedon, N.Y. This type of air-laying equipment uses circulating, forced air to randomize and interengaged the input fibers 405 to make a loose web 415. A conventional mechanical arrangement of opening, carding and crosslapping may also be used. In addition, an arrangement having a combination or mechanical and airlaid forming may be used.

Following formation of the loose web 415, the web may proceed to processing to strengthen or further interconnect the fibers. For example the loose web 415 may proceed to needling.

The loose web 415 exits the web forming apparatus 410 and proceeds to a heating unit 420, such as an oven, to heat and melt the first synthetic fiber 120. The temperature and time within the heating unit 420 must be controlled such that the first synthetic fiber 120 entirely melts while the second synthetic fiber 120 at least partially remains intact. The melted first synthetic fiber 120 tends to migrate and collect at points of intersection of the natural fibers 110 and second synthetic fibers 130. Then, upon cooling, the melted first synthetic fiber 120 coalesces and solidifies to create a secured, interconnected pre-bond web 425.

At this point, the pre-bond web 425 is held together by the melted first synthetic fiber 120. However, to add mechanical strength or abrasiveness to the pre-bond web 425, a binder 200 may be coated on the pre-bond web 425. After the heating unit 420, the pre-bond web 425 may proceed to a coater 430 where a liquid or dry binder could be applied. The coater 430 could be a roller coater, spray coater, immersion coater, powder coater or other known coating mechanism. The coater 430 could apply the binder to a single surface of the pre-bond web 425 or to both surfaces. It is possible that another coater (not shown) may be necessary to coat any remaining uncoated surface. For example, a roll coater may apply a binder to both surfaces of the prebond web 425. A spray coater may apply a binder to a single surface or two spray coating stations may be needed to coat bother surfaces of the pre-bond web 425. Further, depending on the binder 200 separate curing equipment (not shown), such as an oven, may be needed after the coating stations 430. A curing oven may be heated air circulation, infrared or ultraviolet. The heated air circulation oven may use steam, heated oil or electricity heated coils to generate heated air.

The benefiting particle 300 may be included with the binder 200 of the coating. For example, a slurry can be created with the binder 200 and benefiting particle and the slurry can be coated onto the web. Alternatively, the binder 200 may be applied followed by the benefiting particles being dropped, sprinkled, or sprayed on to the binder 200. Depending on the binder 200, following coating, the nonwoven article 100 may be cured. For example, an oven (not shown) may be included following the coating to cure the binder 200.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A scouring material comprising:

a three dimensional nonwoven web of entangled fibers comprising natural vegetable fibers and synthetic fibers;

wherein 40 to 80% wt. of the fibers are natural vegetable fibers;

wherein the synthetic fibers comprise at least first synthetic fibers having a first melting point and second synthetic fibers having a second melting point that is higher than the first melting point;

wherein the first synthetic fibers entirely melt and coalesce at mutual contact point of the natural fibers and second synthetic fibers to bond the fibers together and to create voids;

wherein the bonded web has a maximum density of 60 $kg/m^3$.

2. The scouring material of claim 1, wherein the natural fibers are selected from the group consisting of jute, hemp, agave, coconut fibers and combinations thereof.

3. The scouring material of claim 1, wherein 40 to 70% wt. of the fibers are natural fibers.

4. The scouring material of claim 1, wherein the first synthetic fibers comprise polypropylene.

5. The scouring material of claim 1, wherein the second synthetic fibers comprise polyester, nylon, acrylic fibers or combinations thereof.

6. The scouring material of claim 1, wherein 20 to 60% wt. of the synthetic fibers are first synthetic fibers.

7. The scouring material of claim 1, further comprising a binder coating.

8. The scouring material of claim 1, further comprising benefiting particles are selected from the group consisting of abrasive particles, metal particles, solid detergent particles, solid surfactant particles, solid antimicrobial particles, microcapsules, and combinations thereof.

9. A method of making a scouring material comprising:

providing a plurality of fibers comprising natural fibers and synthetic fibers, wherein 40 to 80% wt. of the fibers are natural vegetable fibers, and wherein the synthetic fibers comprise at least first synthetic fibers having a first melting point and second synthetic fibers having a second melting point that is higher than the first melting point;

mixing the fibers to form a mat;

melting the entire first synthetic fibers to create voids in the mat;

coalescing the melted first synthetic fibers to bond the natural fibers and second synthetic fibers together, wherein the bonded web has a maximum density of 60 $kg/m^3$.

10. The method of claim 9, further comprising:

treating the surface of the natural fibers with a hydroxide chemical, superheated steam, plasma treatment, or gamma ray.

11. The method of claim 9, further comprising:

coating a binder on the mat.

12. The method of claim 11, further comprising:

adhering benefiting particles to the binder, wherein the benefiting particles are selected from the group consisting of abrasive particles, metal particles, solid detergent particles, solid surfactant particles, solid antimicrobial particles, microcapsules, and combinations thereof.

* * * * *